US006088976A

United States Patent [19]

Roy

[11] Patent Number: 6,088,976

[45] Date of Patent: Jul. 18, 2000

[54] REMOVABLE NON-SKID STEP PAD

[76] Inventor: Gilles Roy, 276, Jeannette Street, Laval, Québec, Canada, H7P 5E4

[21] Appl. No.: 09/138,974

[22] Filed: Aug. 24, 1998

[51] Int. Cl.[7] ..... E04F 11/16

[52] U.S. Cl. ..... 52/179; 52/182; 52/184; 52/177; 52/180

[58] Field of Search ..... 52/182, 184, 177, 52/179, 180, 185, 187, 183; 224/901.4

[56] References Cited

U.S. PATENT DOCUMENTS

| | | | |
|---|---|---|---|
| 815,391 | 3/1906 | Weinstock | 52/179 |
| 3,932,792 | 1/1976 | Rossman | 52/183 |
| 4,060,947 | 12/1977 | Naka . | |
| 5,070,664 | 12/1991 | Groh et al. | 52/177 |
| 5,103,608 | 4/1992 | Andreo . | |
| 5,345,633 | 9/1994 | Harnish | 224/901.4 X |
| 5,503,456 | 4/1996 | Rossini | 224/901.4 X |
| 5,588,571 | 12/1996 | Mazzo | 224/901.4 X |

FOREIGN PATENT DOCUMENTS 1276771 11/1990 Canada .

*Primary Examiner*—Carl D. Friedman
*Assistant Examiner*—Phi Dieu Tran A
*Attorney, Agent, or Firm*—Brovillette Kosie

[57] ABSTRACT

The removable non-skid pad covers a portion of a corresponding step of an exterior stair or staircase so as to allow people to use it more safely. The pad comprises a main section to be disposed on the upper horizontal portion of the step, a preformed substantially hooked-shaped from section having one end integrally connected to the front end of the main section so as to fit around the front edge and a part of the bottom portion of the step near the front edge, and a rear section having one end integrally connected to the rear end of the main section. A binding assembly is provided to removably attach the front and rear sections under the step. The pad may be easily installed and removed. Any snow or ice accumulations may be easily dislodged by removing the pad and skating it.

5 Claims, 5 Drawing Sheets

REMOVABLE NON-SKID STEP PAD

BACKGROUND OF THE INVENTION

1. Field of the invention

The present invention relates to a pad more specifically to a removal pad to facilitate life and permit people to use steps more safely.

2. Description of the Prior Act

We know that non-skids pads, self-adhesive strip, or carpet are often installed on steps but during the Winter, they absorb water which turns to ice.

In this new patent, pads cover on the steps and are self-maintained by two safety bindings. Pad installation is easy, does not need any specific tool or skilled worker and can be installed when needed.

SUMMARY OF THE INVENTION

In accordance with this invention, it is an object to provide a removal pad. It is another object to provide a rubber, vinyl, synthetic rubber removal pad It is another object to provide a removal pad with an irregular measurement, of different thicknesses (to be decided) and that will cover up the step area. It is another object to provide a removal pad that covers the front and the bottom part of the steps with a piece that is rounded to reinforce the pad and permit the buckle to be firmly maintain to the steps. It is another object to provide a removal pad that will also cover up, at the other end, the backside lower part of the step with clips at its end and straps that go from the front buckle through the back buckle and tie it together. It is another object to provide a removal pad that goes over the step and tightens together with velcro or other fastener. It is another object to provide a non-skid rubber removal pad with deep cavities on top, to remove ice or snow just by removing the pad from the step and shaking it. It is yet another object to provide a removal pad that can be replaced if it breaks, without removal of the other ones.

No 13—shows the cavities

No 14—shows pad surface

No 15—shows the front and back buckles used to secure the strap

No 16—shows clip to fix with flexibility the roll and the buckle

No 17—shows roll that serves to thighten front part to back part

No 18—shows the strap

Figure 3:
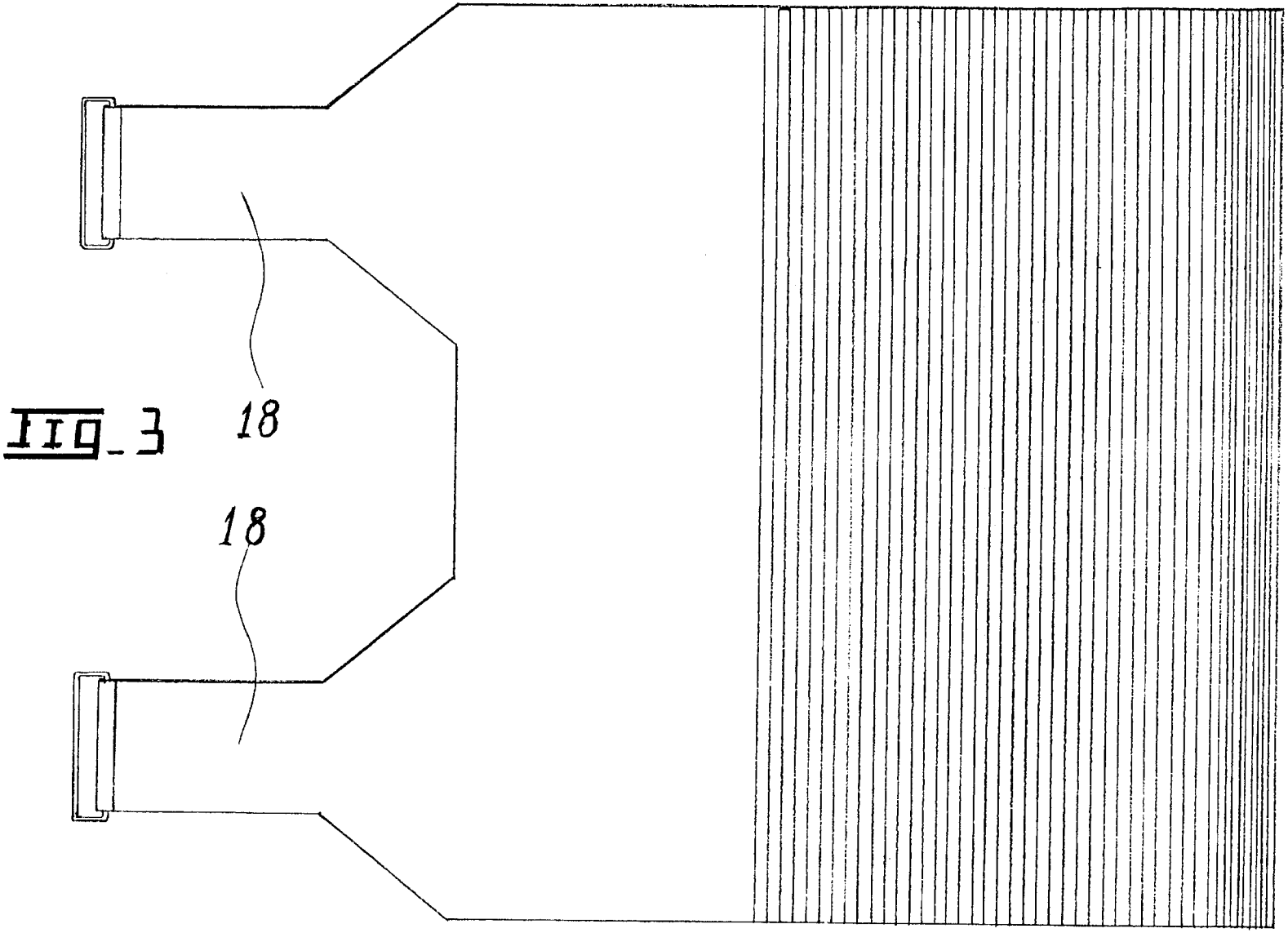

FIG. 3 is a view of top surface of the pad

Figure 4:
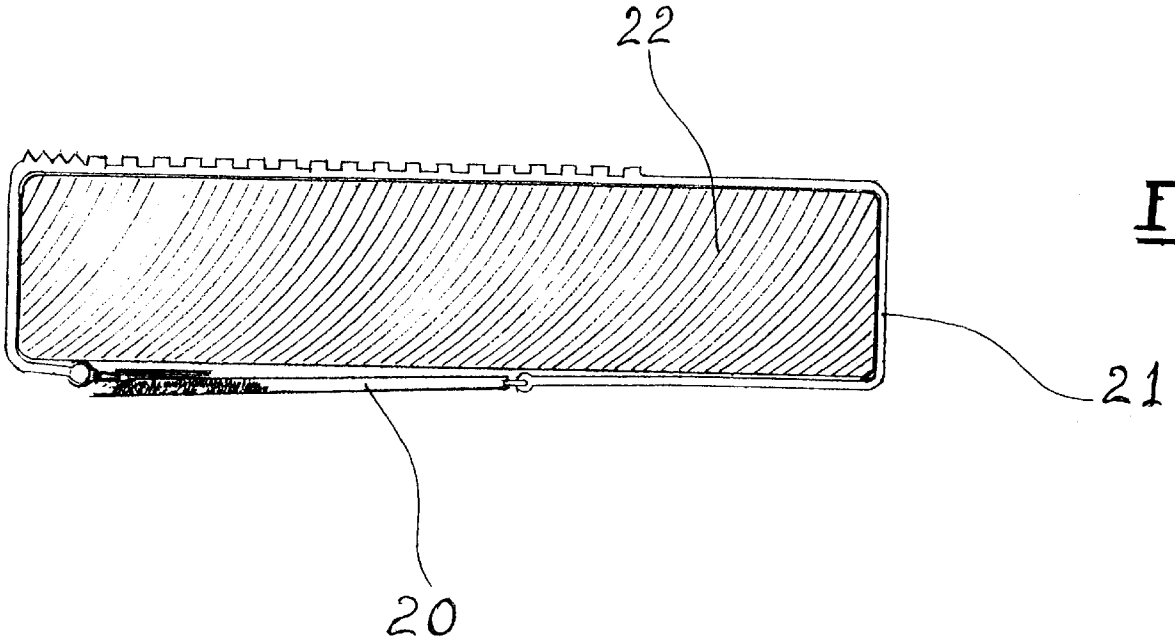

FIG. 4 is a profile section view of step

Figure 5:
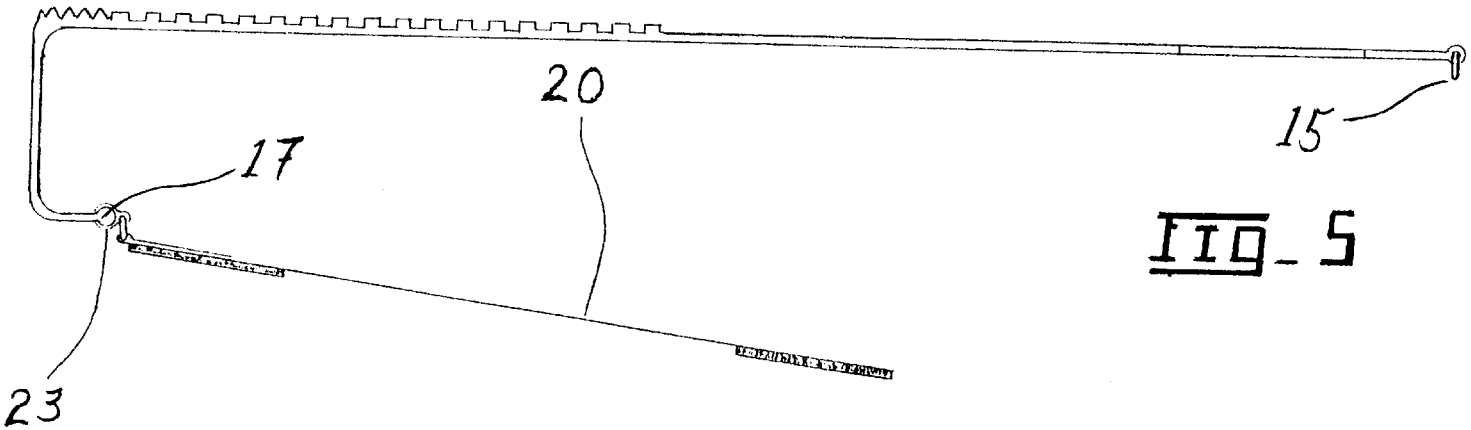

No 20—shows the strap that folds over itself and holds both parts to the step No 21—shows back part of the pad No 22—shows the covered step FIG. 5 is a profile view of a stretch strap (20) from buckle (15) to clip (23) to roll (17)

Figure 6:
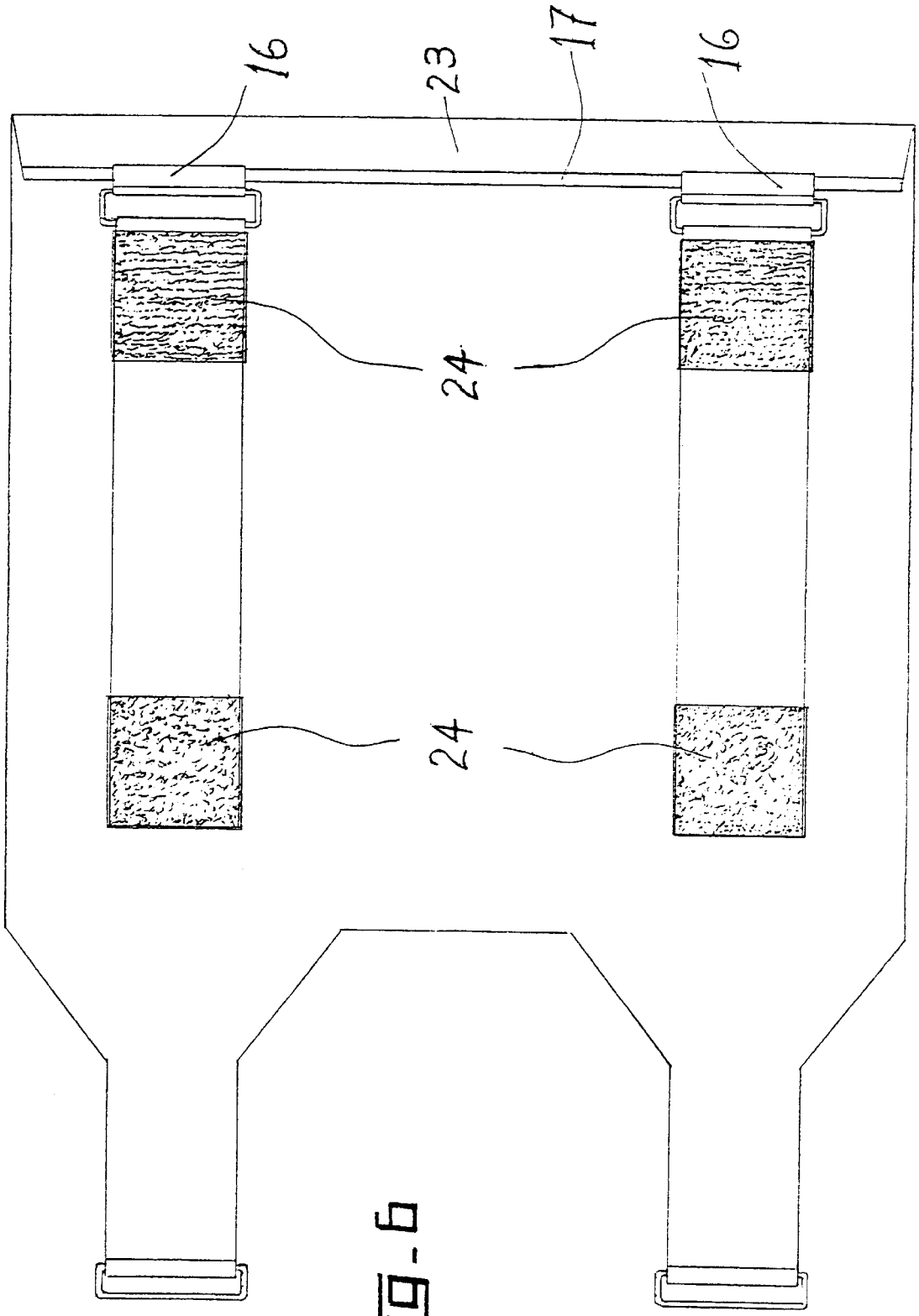

FIG. 6 is an underview of the pad showing the clips (16) that hold roll and buckles.

No 23—shows underview of the pad extension from the front part, finishing in roll part (17)

No 24—shows velcros fixed at both strap ends (20).

DESCRIPTION OF THE PREFERRED EMBODIMENTS

Figure 1:
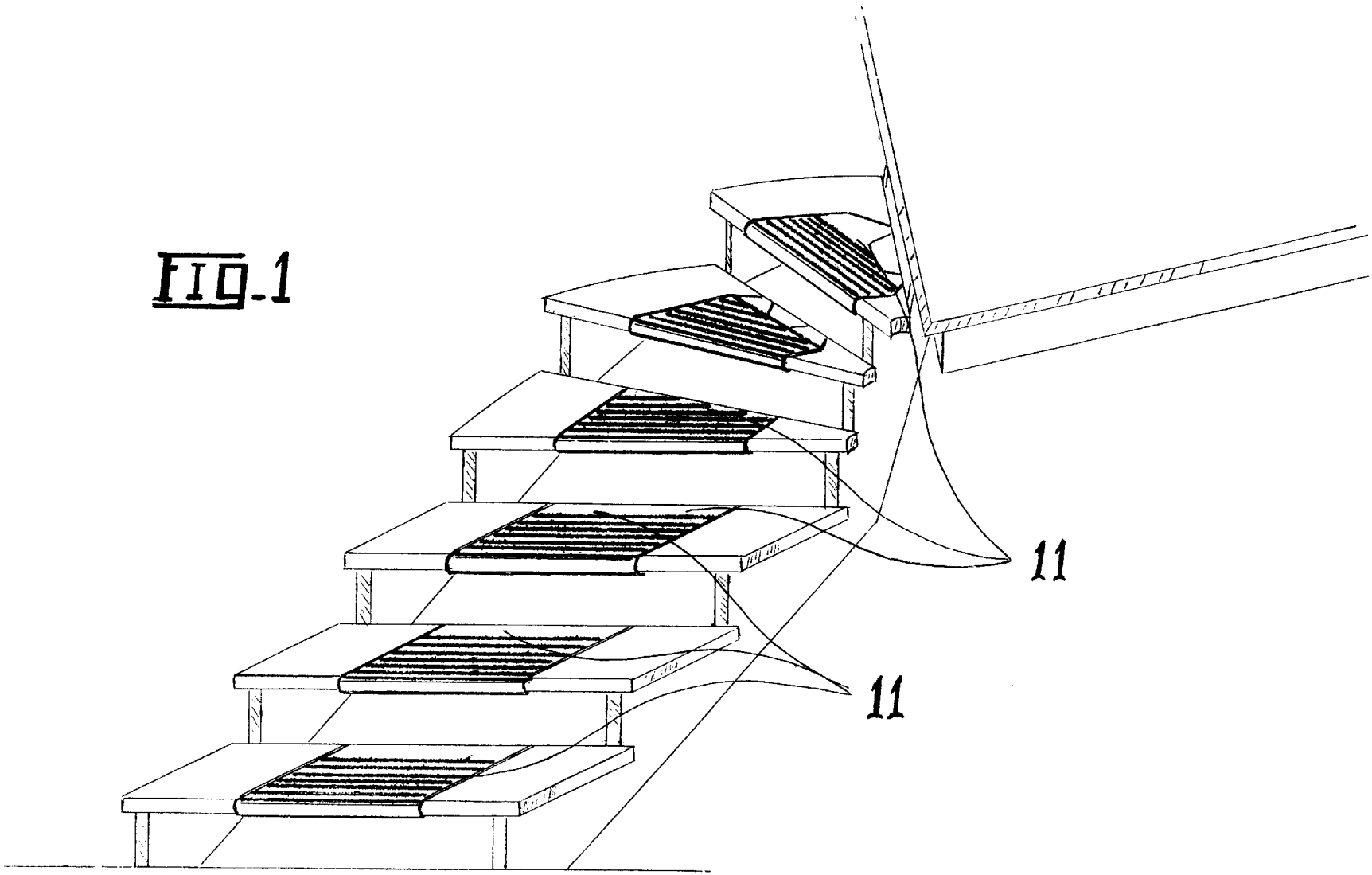
FIG. 1 is a perspective view of pad use
Figure 2:
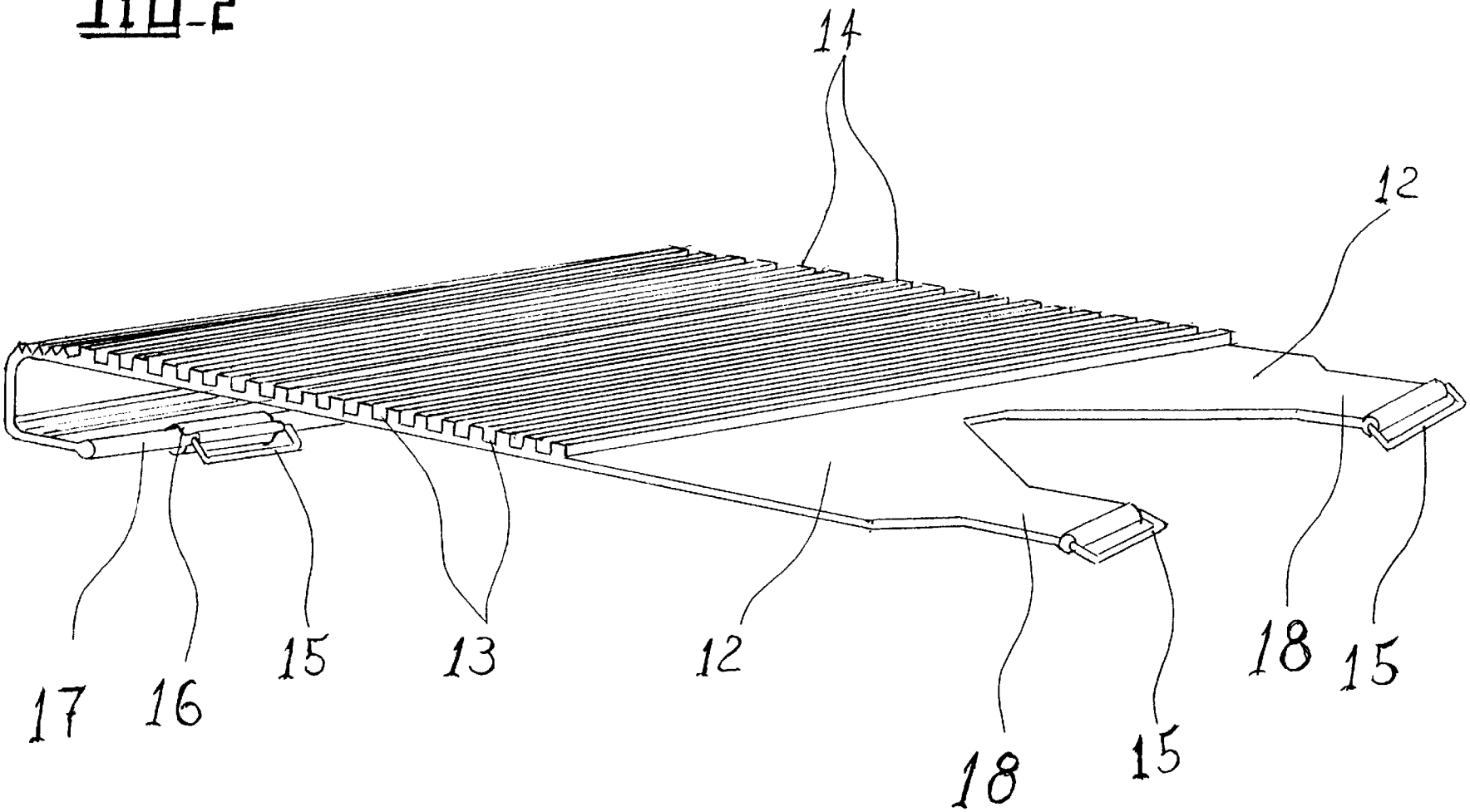
FIG. 2 is a perspective view of pad stretching

The products presently being used on the market today like exterior carpet require installations that can sometimes be difficult. For example, support anchors must be fixed to each step allowing the metal rod to hold securely. The installation requires trained workers. Refering to FIG. 2, the removal of ice build up during the Winter is also tedious and ineffective. If the carpet rips, the whole carpet needs to be replaced.

In accordance with one embodiment of this invention refering to FIGS. 3, 4, 5 and 6 a universal removal pad which is designed to cover up step, thighten to it and be easily removed,

I claim:

1. A removable non-skid pad for covering an individual step of a stair or staircase, the step having an upper portion, a bottom portion, a front edge and a rear edge, the pad comprising:

a main section to be disposed on the upper portion of the step, the main section being made of a flexible material and having a front and a rear end;

a preformed substantially hooked-shaped front section having one end integrally connected to the front end of the main section, the front section being sized to fit around the front edge and a part of the bottom portion of the step near the front edge;

a rear section having one end integrally connected to the rear end of the main section, the rear section being made of a flexible material and sized to bend around the rear edge of the step; and a binding assembly to removably attach the front and rear sections;

the main section comprises an upper surface provided with a plurality of transversally-disposed.

2. A removable pad according to claim 1, wherein the binding assembly comprises: a plurality of pairs of buckles, each pair including a front buckle connected to the front section and a rear buckle connected to the rear section; a plurality of straps, each respectively connecting together the front buckle and the rear buckle of a corresponding pair of buckles.

3. A removable pad according to claim 2, wherein each strap comprises a first and a second end, the first end being attached to one of the buckles of a corresponding pair of buckles, the strap being insertable through the other buckle of the pair to form a loop and the second end of the strap being removably connectable to a bottom surface of the strap.

4. A removable pad according to claim 3, wherein the second end of the strap is removably connected to the bottom surface of the strap by means of Velcro pieces.

5. A removable pad according to claim 1, wherein the main section, the front section and the rear section are provided as a single piece made of a non-skid material selected among the group composed of natural rubber, synthetic rubber and vinyl.

* * * * *